US007297190B1

(12) United States Patent
Dordi et al.

(10) Patent No.: US 7,297,190 B1
(45) Date of Patent: Nov. 20, 2007

(54) PLATING SOLUTIONS FOR ELECTROLESS DEPOSITION OF COPPER

(75) Inventors: Yezdi Dordi, Palo Alto, CA (US); William Thie, Mountain View, CA (US); Algirdas Vaskelis, Vilnius (LT); Eugenijus Norkus, Vilnius (LT); Jane Jaciauskiene, Vilnius (LT); Aldona Jagminiene, Vilnius (LT)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 11/427,266

(22) Filed: Jun. 28, 2006

(51) Int. Cl.
*C23C 18/38* (2006.01)

(52) U.S. Cl. ..... 106/1.23; 106/1.26

(58) Field of Classification Search ..... 106/1.23, 106/1.26
See application file for complete search history.

(56) References Cited

U.S. PATENT DOCUMENTS 3,403,035 A * 9/1968 Schneble, Jr. et al. ... 427/443.1
3,935,013 A * 1/1976 Lelental ..... 430/16
4,143,186 A * 3/1979 Davis ..... 427/345
4,265,943 A * 5/1981 Goldstein et al. ..... 427/305
4,301,196 A * 11/1981 McCormack et al. ..... 427/99.1
4,303,443 A * 12/1981 Miyazawa et al. ..... 106/1.23
4,450,191 A * 5/1984 Arcilesi ..... 427/443.1
4,482,596 A * 11/1984 Gulla et al. ..... 428/131
4,650,691 A * 3/1987 Kinoshita et al. ..... 427/8
6,911,068 B2 * 6/2005 Cobley et al. ..... 106/1.25
2007/0048447 A1 * 3/2007 Lee et al. ..... 427/305

* cited by examiner

*Primary Examiner*—Helene Klemanski
(74) *Attorney, Agent, or Firm*—Martine Penilla & Gencarella, LLP

(57) ABSTRACT

An electroless copper plating solution is disclosed herein. The solution includes an aqueous copper salt component, an aqueous cobalt salt component, a polyamine-based complexing agent, a chemical brightener component, a halide component, and a pH-modifying substance in an amount sufficient to make the electroless copper plating solution acidic. A method of preparing an electroless copper solution is also provided.

25 Claims, 1 Drawing Sheet

PLATING SOLUTIONS FOR ELECTROLESS DEPOSITION OF COPPER

BACKGROUND

The fabrication of semiconductor devices such as integrated circuits, memory cells, and the like, involve a series of manufacturing operations that are performed to define features on semiconductor wafers ("wafers"). The wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

To build an integrated circuit, transistors are first created on the surface of the wafer. The wiring and insulating structures are then added as multiple thin-film layers through a series of manufacturing process steps. Typically, a first layer of dielectric (insulating) material is deposited on top of the formed transistors. Subsequent layers of metal (e.g., copper, aluminum, etc.) are formed on top of this base layer, etched to create the conductive lines that carry the electricity, and then filled with dielectric material to create the necessary insulators between the lines. The process used for producing copper lines is referred to as a dual Damascene process, where trenches are formed in a planar conformal dielectric layer, vias are formed in the trenches to open a contact to the underlying metal layer previously formed, and copper is deposited everywhere. Copper is then planarized (overburden removed), leaving copper in the vias and trenches only.

Although copper lines are typically comprised of a plasma vapor deposition (PVD) seed layer (i.e., PVD Cu) followed by an electroplated layer (i.e., ECP Cu), electroless chemistries are under consideration for use as a PVD Cu replacement, and even as an ECP Cu replacement. A process called electroless copper deposition can thus be used to build the copper conduction lines. During electroless copper deposition, electrons are transferred from a reducing agent to the copper ions resulting in the deposition of reduced copper onto the wafer surface. The formulation of the electroless copper plating solution is optimized to maximize the electron transfer process involving the copper ions.

Conventional formulations call for maintaining the electroless plating solution at a high alkaline pH (i.e., pH>9) to enhance the overall deposition rate. The limitations with using highly alkaline copper plating solutions for electroless copper deposition are non-compatibility with positive photoresist on the wafer surface, longer induction times, and decreased nucleation density due to an inhibition by hydroxylation of the copper interface (which occurs in neutral-to-alkaline environments). These are limitations that can be eliminated if the solution is maintained at an acidic pH environment (i.e., pH<7). One prominent limitation found with using acidic electroless copper plating solutions is that certain substrate surfaces, such as tantalum nitride (TaN), tend to get oxidized readily in an alkaline environment causing adhesion problems for the reduced copper resulting in blotchy plating on the TaN surfaces of the wafer. Efforts to counteract this limitation by seeding the TaN surfaces with various metals such as palladium and ruthenium have resulted in minimal levels of success primarily due to increase of the line resistance.

In view of the forgoing, there is a need for improved formulations of copper plating solutions that can be maintained in an acidic pH environment for use in electroless copper deposition processes.

SUMMARY

Broadly speaking, the present invention fills these needs by providing improved formulations of copper plating solutions that can be maintained in an acidic pH environment for use in electroless copper deposition processes. It should be appreciated that the present invention can be implemented in numerous ways, including as a method and a chemical solution. Several inventive embodiments of the present invention are described below.

In one exemplary embodiment, an electroless copper plating solution is disclosed. The solution includes an aqueous copper salt component, an aqueous cobalt salt component, a polyamine-based complexing agent, a chemical brightener component, and a pH-modifying substance. In another embodiment, the electroless copper plating solution includes an aqueous copper salt component with a concentration range between about 0.001 molarity (M) to the salt solubility limit. In yet another embodiment, the electroless copper plating solution includes an aqueous cobalt salt component with a concentration range between about 0.001 molarity (M) to the salt solubility limit. In still another embodiment, an electroless copper plating solution includes a complexing agent having a triamine group with a concentration range between about 0.005 molarity (M) to about 10.0M. In still yet another embodiment, an electroless copper plating solution includes a chemical brightener component with a concentration range between about 0.000001 molarity (M) to about 0.01 M.

In another aspect of the invention, a method for preparing an electroless copper plating solution is disclosed. The method involves combining the aqueous copper salt component, a portion of the complexing agent component, a chemical brightener component, a halide component, and the acid component of the plating solution into a first mixture. The aqueous cobalt salt component and the remainder of the complexing agent is combined into a second mixture. Prior to use in an electroless copper deposition operation, the first mixture and second mixture are integrated into the final copper plating solution.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Figure 1:
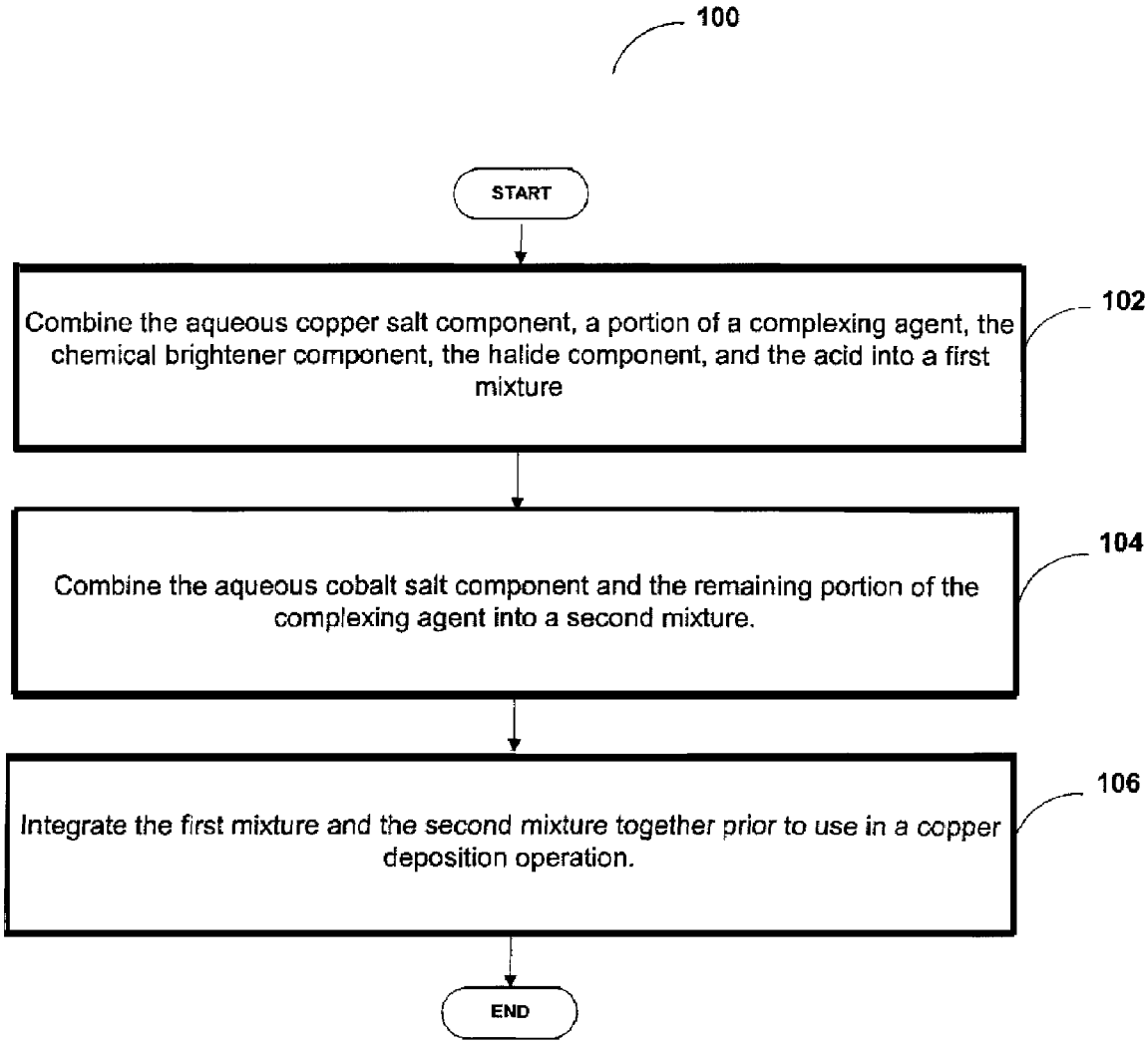
FIG. 1 is a flow chart of a method for preparing an electroless copper plating solution, in accordance with one embodiment of the present invention.

An invention is described for providing improved formulations of electroless copper plating solutions that can be maintained in an acidic pH to weakly alkaline environment for use in electroless copper deposition processes. It will be obvious, however, to one skilled in the art, that the present invention may be practiced without some or all of these specific details. In other instances, well known process operations have not been described in detail in order not to unnecessarily obscure the present invention.

Electroless metal deposition processes used in semiconductor manufacturing applications are based upon simple electron transfer concepts. The processes involve placing a prepared semiconductor wafer into an electroless metal plating solution bath then inducing the metal ions to accept electrons from a reducing agent resulting in the deposition of the reduced metal onto the surface of the wafer. The success of the electroless metal deposition process is highly dependent upon the various physical (e.g., temperature, etc.) and chemical (e.g., pH, reagents, etc.) parameters of the plating solution. As used herein, a reducing agent is an element or compound in an oxidation-reduction reaction that reduces another compound or element. In doing so, the reducing agent becomes oxidized. That is, the reducing agent is an electron donor that donates an electron to the compound or element being reduced.

A complexing agent (i.e., chelators or chelating agent) is any chemical agent that can be utilized to reversibly bind to compounds and elements to form a complex. A salt is any ionic compound composed of positively charged cations (e.g., Cu2+, etc.) and negatively charged anions, so that the product is neutral and without a net charge. A simple salt is any salt species that contain only one kind of positive ion (other than the hydrogen ion in acid salts). A complex salt is any salt species that contains a complex ion that is made up of a metallic ion attached to one or more electron-donating molecules. Typically a complex ion consists of a metallic atom or ion to which is attached one or more electron-donating molecules (e.g., Cu(II)ethylenediamine2+, etc.). A protonized compound is one that has accepted a hydrogen ion (i.e., H+) to form a compound with a net positive charge.

A copper plating solution for use in electroless copper deposition applications is disclosed below. The components of the solution are a copper(II) salt, a cobalt(II) salt, a chemical brightener component, and a polyamine-based complexing agent. In one exemplary embodiment, the copper plating solution is prepared using de-oxygenated liquids. Use of de-oxygenated liquids substantially eliminates oxidation of the wafer surfaces and nullifies any effect that the liquids may have on the redox potential of the final prepared copper plating solution. In one embodiment, the copper plating solution further includes a halide component. Examples of halide species that can be used include fluoride, chloride, bromide, and iodide. In one embodiment, the concentration of the halide component is between about 0.0001 molarity (M) and about 5 M. In another embodiment the halide component is selected from a group consisting of potassium bromide, lithium chloride, potassium iodide, chlorine fluoride, ammonium chloride, ammonium bromide, ammonium fluoride and ammonium iodide.

In one embodiment, the copper(II) salt is a simple salt. Examples of simple copper(II) salts include copper(II) sulfate, copper (II) nitrate, copper(II) chloride, copper(II) tetrafluoroborate, copper(II) acetate, and mixtures thereof. It should be appreciated that essentially any simple salt of copper(II) can be used in the solution so long as the salt can be effectively solubilized into solution, be complexed by a polyamine-based complexing agent, and oxidized by a reducing agent in an acidic environment to result in deposition of the reduced copper onto the surface of the wafer.

In one embodiment, the copper(II) salt is a complex salt with a polyamine electron-donating molecule attached to the copper(II) ion. Examples of complex copper(II) salts include copper(II) ethylenediamine sulfate, bis(ethylenediamine) copper(II) sulfate, copper(II)diethylenetriamine nitrate, bis (diethylenetriamine)copper(II) nitrate, and mixtures thereof. It should be appreciated that essentially any complex salt of copper(II) attached to a polyamine molecule can be used in the solution so long as the resulting salt can be solubilized into solution, be complexed to a polyamine-based complexing agent, and oxidized by a reducing agent in an acidic environment to result in deposition of the reduced copper onto the surface of the wafer.

In one embodiment, the concentration of the copper(II) salt component of the copper plating solution is maintained at a concentration of between about 0.0001 molarity (M) and the solubility limit of the various copper(II) salts disclosed above. In another exemplary embodiment, the concentration of the copper(II) salt component of the copper plating solution is maintained at between about 0.001 M and 1.0 M or the solubility limit. It should be understood that the concentration of the copper(II) salt component of the copper plating solution can essentially be adjusted to any value up to the solubility limit of the copper(II) salt as long as the resulting copper plating solution can effectuate electroless deposition of copper on a wafer surface during an electroless copper deposition process.

In one embodiment, the cobalt(II) salt is a simple cobalt salt. Examples of simple cobalt(II) salts include cobalt(II) sulfate, cobalt(II) chloride, cobalt(II) nitrate, cobalt(II) tetrafluoroborate, cobalt(II) acetate, and mixtures thereof. It should be understood that essentially any simple salt of cobalt(II) can be used in the solution so long as the salt can be effectively solubilized in the solution, be complexed to a polyamine-based complexing agent, and reduce a cobalt(II) salt in an acidic environment to result in the deposition of the reduced copper onto the surface of the wafer.

In another embodiment, the cobalt(II) salt is a complex salt with a polyamine electron-donating molecule attached to the cobalt(II) ion. Examples of complex cobalt(II) salts include cobalt(II) ethylenediamine sulfate, bis(ethylenediamine)cobalt(II) sulfate, cobalt(II) diethylenetriamine nitrate, bis(diethylenetriamine)cobalt(II) nitrate, and mixtures thereof. It should be understood that essentially any simple salt of cobalt(II) can be used in the solution so long as the salt can be effectively solubilized into solution, be complexed to a polyamine-based complexing agent, and reduce a copper(II) salt in an acidic environment to result in the deposition of the reduced copper onto the surface of the wafer.

In one embodiment, the concentration of the cobalt(II) salt component of the copper plating solution is maintained at between about 0.0001 molarity (M) and the solubility limit of the various cobalt(II) salt species disclosed above. In one exemplary embodiment, the concentration of the cobalt (II) salt component of the copper plating solution is maintained at between about 0.001 M and 1.0 M. It should be understood that the concentration of the cobalt(II) salt component of the copper plating solution can essentially be adjusted to any value up to the solubility limit of the cobalt(II) salt as long as the resulting copper plating solution can effectuate electroless deposition of copper on a wafer surface at an acceptable rate during an electroless copper deposition process.

In one embodiment, the chemical brightener component works within the film layer to control copper deposition on a microscopic level. The brightener tends to be attracted to points of high electro-potential, temporarily packing the area and forcing copper to deposit elsewhere in this embodiment. It should be appreciated that as soon as the deposit levels, the local point of high potential disappears and the brightener drifts away, i.e., brighteners inhibit the normal tendency of the copper plating solution to preferentially plate areas of high potential which would inevitably result in rough, dull plating. By continuously moving between surfaces with the highest potential, brighteners (also referred to as levelers) prevent the formation of large copper crystals, giving the highest possible packing density of small equiaxed crystals (i.e., nucleation enhancement), which results in a smooth, glossy, high ductility copper deposition in this embodiment. One exemplary brightener is bis-(3-sulfopropyl)-disulfide disodium salt (SPS), however, any small molecular weight sulfur containing compounds that increase the plating reaction by displacing an adsorbed carrier may function in the embodiments described herein. In one embodiment, the concentration of the chemical brightener component is maintained at between about 0.000001 molarity (M) and the solubility limit for the brightener. In another embodiment, the chemical brightener component has a concentration of between about 0.000001 M and about 0.01 M. In still another embodiment, the chemical brightener has a concentration of about between 0.000141 M and about 0.000282 M. It should be appreciated that the concentration of the chemical brightener component of the copper plating solution can essentially be adjusted to any value up to the solubility limit of the chemical brightener as long as the nucleation enhancing properties of the chemical brightener is maintained in the resulting copper plating solution to allow for a sufficiently dense deposition of copper on the wafer surface.

In one embodiment, the polyamine-based complexing agent is a diamine compound. Examples of diamine compounds that can be utilized for the solution include ethylenediamine, propylenediamine, 3-methylenediamine, and mixtures thereof. In another embodiment, the polyamine-based complexing agent is a triamine compound. Examples of triamine compounds that can be utilized for the solution include diethylenetriamine, dipropylenetriamine, ethylene propylenetriamine, and mixtures thereof. In still another embodiment, the polyamine-based complexing agent is an aromatic or cyclic polyamine compound. Examples of aromatic polyamine compounds include benzene-1,2-diamine, pyridine, dipyride, pyridine-1-amine. It should be understood that essentially any diamine, triamine, or aromatic polyamine compound can be used as the complexing agent for the plating solution so long as the compound can complex with the free metal ions in the solution (i.e., copper(II) metal ions and cobalt(II) metal ions), be readily solubilized in the solution, and be protonized in an acidic environment. In one embodiment, other chemical additives including accelerators (i.e., sulfopropyl sulfonate) and suppressors (i.e., PEG, polyethylene glycol) are included in the copper plating solution at low concentrations to enhance the application specific performance of the solution.

In another embodiment, the concentration of the complexing agent component of the copper plating solution is maintained at between about 0.0001 molarity (M) and the solubility limit of the various diamine-based, triamine-based, and aromatic or cyclic polyamine complexing agent species disclosed above. In one exemplary embodiment, the concentration of the complexing agent component of the copper plating solution is maintained at between about 0.005 M and 10.0 M, but must be greater than the total metal concentration in solution.

Typically, the complexing agent component of a copper plating solution causes the solution to be highly alkaline and therefore somewhat unstable (due to too large a potential difference between the copper(II)-cobalt(II) redox couple). In one exemplary embodiment, an acid is added to the plating solution in sufficient quantities to make the solution acidic with a pH≦about 6.8. In another embodiment, a buffering agent is added to make the solution acidic with a pH≦about 6.8 and to prevent changes to the resulting pH of the solution after adjustment. In still another embodiment, an acid and/or a buffering agent is added to maintain the pH of the solution at between about 4.0 and 6.8. In yet another embodiment, an acid and/or a buffering agent is added to maintain the pH of the solution at between about 4.3 and 4.6. In one embodiment, the anionic species of the acid matches the respective anionic species of the copper(II) and cobalt (II) salt components of the copper plating solution, however it should be appreciated that the anionic species do not have to match. In yet another embodiment, a pH modifying substance is added to make the solution weakly alkaline, i.e., a pH of less than about 8.

Acidic copper plating solutions have many operational advantages over alkaline plating solutions when utilized in an electroless copper deposition application. An acidic copper plating solution improves the adhesion of the reduced copper ions that are deposited on the wafer surface. This is often a problem observed with alkaline copper plating solutions due to the formation of hydroxyl-terminated groups, inhibiting the nucleation reaction and causing reduced nucleation density, larger grain growth and increased surface roughness. Still further, for applications such as direct patterning of copper lines by electroless deposition of copper through a patterned film, an acidic copper plating solution helps improve selectivity over the barrier and mask materials on the wafer surface, and allows the use of a standard positive resist photomask resin material that would normally dissolve in a basic solution.

In addition to the advantages discussed above, copper deposited using the acidic copper plating solutions exhibits lower pre-anneal resistance characteristics than with copper deposited using alkaline copper plating solutions. It should be appreciated that the pH of the copper plating solutions, as disclosed herein, can essentially be adjusted to any acidic (i.e., pH<7.0) environment so long as the resulting deposition rates of copper during the electroless copper deposition process is acceptable for the targeted application and the solution exhibits all the operational advantages discussed above. In general, as the pH of the solution is lowered (i.e., made more acidic), the copper deposition rate decreases. However, varying the choice of complexing agent (e.g., diamine-based, triamine-based, aromatic polyamine, etc.) plus the concentration of the copper(II) and cobalt(II) salts can help compensate for any reduction in copper deposition rate resulting from an acidic pH environment.

In one embodiment, the copper plating solution is maintained at a temperature between about 0° Celsius (° C.) and 70° C. during an electroless copper deposition process. In one exemplary embodiment, the copper plating solution is maintained at a temperature of between about 20° C. and 70° C. during the electroless copper deposition process. It should be appreciated that temperature impacts the nucleation density and deposition rate of copper (mainly, the nucleation density and deposition rate of copper is directly proportional to temperature) to the wafer surface during copper deposition. The deposition rate impacts the thickness of the resulting copper layer and the nucleation density impacts void space, occlusion formation within the copper layer, and adhesion of the copper layer to the underlying barrier material. Therefore, the temperature settings for the copper plating solution during the electroless copper deposition process would be optimized to provide dense copper nucleation and controlled deposition following the nucleation phase of the bulk deposition to optimize the copper deposition rate to achieve copper film thickness targets.

FIG. 1 is a flow chart of a method for preparing an electroless copper plating solution, in accordance with one embodiment of the present invention. Method 100 begins with operation 102 where the aqueous copper salt component, a portion of the polyamine-based complexing agent, the chemical brightener component, the halide component, and a portion of the acid component of the copper plating solution are combined into a first mixture. The method 100 proceeds on to operation 104 where the remaining portion of the complexing agent and the aqueous cobalt salt component are combined into a second mixture. In one embodiment, the pH of the second mixture is adjusted so that the second mixture has an acidic pH. It should be appreciated that the advantage of keeping the second mixture acidic is that this will keep the cobalt(II) in an active form. The method 100 then continues on to operation 106 where the first mixture and the second mixture are combined into the final copper plating solution prior to use in a copper plating operation.

In one embodiment, the first and the second mixtures are stored in separate permanent storage containers prior to integration. The permanent storage containers being designed to provide transport and long-term storage of the first and second mixtures until they are ready to be combined into the final copper plating solution. Any type of permanent storage container may be used as long as the container is non-reactive with any of the components of the first and the second mixtures. It should be appreciated that this pre-mixing strategy has the advantage of formulating a more stable copper plating solution that will not plate out (that is, resulting in the reduction of the copper) over time in storage.

This invention can be further understood in reference to Example 1 which describes a sample formulation of copper plating solution, in accordance with one embodiment of the present invention.

EXAMPLE 1

Nitrate-Based Copper Plating Formulation

In this embodiment, a nitrate-based formulation of the copper plating solution is disclosed with a pH of 6.0, a copper nitrate ($Cu(NO_3)_2$) concentration of 0.05M, a cobalt nitrate ($Co(NO_3)_2$) concentration of 0.15M, an ethylenediamine (i.e., diamine-based complexing agent) concentration of 0.6M, a nitric acid ($HNO_3$) concentration of 0.875M, a potassium bromide (i.e., halide component) concentration of 3 millimolarity (mM), and a SPS (i.e., chemical brightener) concentration of between about 0.000141 M and about 0.000282 M. The resulting mixture is then deoxygenated using Argon gas to reduce the potential for the copper plating solution to become oxidized.

Continuing with Example 1, in one embodiment, the nitrate-based formulation of the copper plating solution is prepared using a pre-mixing formulation strategy that involves pre-mixing a portion of the ethylenediamine with the copper nitrate, the nitric acid, and the potassium bromide into a into a first pre-mixed solution. The remaining portion of the complexing agent component is pre-mixed with the cobalt salt component into a second pre-mixed solution. The first premixed solution and second pre-mixed solution are then added into an appropriate container for final mixing into the final electroless copper plating solution prior to use in an electroless copper deposition operation. As disclosed above, this pre-mixing strategy has the advantage of formulating a more stable copper plating solution that will not plate out over time in storage.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed is:

1. An electroless copper plating solution, comprising:

an aqueous copper salt component;

an aqueous cobalt salt component;

a polyamine-based complexing agent;

a chemical brightener component; and a pH-modifying substance in an amount sufficient to make the electroless copper plating solution have a pH of less than about 8, wherein the pH-modifying substance is selected from a group consisting of sulfuric acid, nitric acid, hydrochloric acid, fluoroboric acid, and acetic acid.

2. The electroless copper plating solution, as recited in claim 1, wherein, the aqueous copper salt component is selected from a group consisting of copper(II) sulfate, copper(II) nitrate, copper(II) chloride, copper(II) tetrafluoroborate, copper(II) acetate, ethylenediamine copper(II) sulfate, bis(ethylenediamine)copper(II) sulfate, and diethyleneamine copper(II) nitrate.

3. The electroless copper plating solution, as recited in claim 1, wherein, the aqueous cobalt salt component is selected from a group consisting of cobalt(II) sulfate, cobalt(II) nitrate, cobalt(II) chloride, cobalt(II) tetrafluoroborate, cobalt (II) acetate, ethylenediamine cobalt(II) sulfate, bis(ethylenediamine)cobalt(II) sulfate, tris(ethylenediamine) cobalt(II) sulfate, and diethyleneamine cobalt(II) nitrate.

4. The electroless copper plating solution, as recited in claim 1, wherein, the polyamine-based complexing agent is selected from a group consisting of a diamine compound, a triamine compound, or an aromatic polyamine compound.

5. The electroless copper plating solution, as recited in claim 4, wherein, the diamine compound is selected from a group consisting of 3-methylenediamine, ethylenediamine, and propylenediamine.

6. The electroless copper plating solution, as recited in claim 4, wherein, the aromatic polyamine compound is selected from a group consisting of benzene-1,2-diamine, pyridine, dipyride, and pyridine-1-amine.

7. The electroless copper plating solution, as recited in claim 1, wherein, a pH of the electroless copper plating solution is between about 4.0 and about 6.8.

8. The electroless copper plating solution, as recited in claim 1, further including a halide component.

9. The electroless copper plating solution, as recited in claim 8, wherein, the halide component has a concentration between about 0.0001 molarity (M) to about 5.0M.

10. The electroless copper plating solution, as recited in claim 9, wherein, the halide component is selected from a group consisting of potassium bromide, lithium chloride, potassium iodide, chlorine fluoride, ammonium chloride, ammonium bromide, ammonium fluoride and ammonium iodide.

11. The electroless copper plating solution, as recited in claim 1, wherein the chemical brightener component is bis-(3-sulfopropyl)-disulfide disodium salt (SPS).

12. An electroless copper plating solution, comprising:

an aqueous copper salt component having a concentration between about 0.001 molarity (M) to a solubility limit for the aqueous copper salt component;

an aqueous cobalt salt component;

a polyamine-based complexing agent;

a chemical brightener component; and a pH-modifying substance in an amount sufficient to make the electroless copper plating solution have a pH of less than about 8 wherein, the pH-modifying substance is selected from a group, consisting of sulfuric acid, nitric acid, hydrochloric acid, fluoroboric acid, and acetic acid.

13. The electroless copper plating solution, as recited in claim 12, further including a halide component.

14. An electroless copper plating solution, comprising:

an aqueous copper salt component;

an aqueous cobalt salt component having a concentration between about 0.001 molarity (M) to a solubility limit for the aqueous cobalt salt component;

an aromatic polyamine-based complexing agent, the aromatic polyamine-based complexing agent selected from a group consisting of benzene-1,2-diamine, pyridine, dipyride, and pyridine-1-amine;

a chemical brightener component; and a pH-modifying substance in an amount sufficient to make the electroless copper plating solution have a pH of less than about 8.

15. The electroless copper plating solution, as recited in claim 14, further including a halide component.

16. An electroless copper plating solution, comprising:

an aqueous copper salt component;

an aqueous cobalt salt component;

a polyamine-based complexing agent having a concentration between about 0.005 molarity (M) to about 10.0M;

a chemical brightener component; and a pH-modifying substance in an amount sufficient to make the electroless copper plating solution have a pH of less than about 8, wherein, the pH-modifying substance is selected from a group consisting of sulfuric acid, nitric acid, hydrochloric acid, fluoroboric acid, and acetic acid.

17. The electroless copper plating solution, as recited in claim 16, further including a halide component.

18. An electroless copper plating solution, comprising:

an aqueous copper salt component;

an aqueous cobalt salt component;

an aromatic polyamine-based complexing agent, the aromatic polyamine-based complexing agent selected from a group consisting of benzene-1,2-diamine, pyridine, dipyride, and pyridine-1-amine;

a chemical brightener component having a concentration between about 0.000001 molarity (M) to about 0.01M; and a pH-modifying substance in an amount sufficient to make the electroless copper plating solution have a pH of less than about 8.

19. The electroless copper plating solution, as recited in claim 18, further including a halide component.

20. A method for preparing an electroless copper plating solution comprising:

combining an aqueous copper salt component, a portion of a complexing agent, a chemical brightener component, a halide component, and an acid as a first mixture;

combining an aqueous cobalt salt component and a remaining portion of the complexing agent as a second mixture; and incorporating the first mixture and the second mixture together prior to use in a copper deposition operation.

21. The method for preparing an electroless copper plating solution, as recited in claim 20, wherein, the aqueous copper salt component is selected from a group consisting of copper(II) sulfate, copper(II) nitrate, copper(II) chloride, copper(II) tetrafluoroborate, copper(II) acetate, ethylenediamine copper(II) sulfate, bis(ethylenediamine)copper(II) sulfate, and diethyleneamine copper(II) nitrate.

22. The method for preparing an electroless copper plating solution, as recited in claim 20, wherein, the aqueous cobalt salt component is selected from a group consisting of cobalt(II) sulfate, cobalt(II) nitrate, cobalt(II) chloride, cobalt(II) tetrafluoroborate, cobalt (II) acetate, ethylenediamine cobalt(II) sulfate, bis(ethylenediamine)cobalt(II) sulfate, tris(ethylenediamine) cobalt (II) sulfate, and diethyleneamine cobalt(II) nitrate.

23. The method for preparing an electroless copper plating solution, as recited in claim 20, wherein the chemical brightener is bis-(3-sulfopropyl)-disulfide disodium salt (SPS).

24. The method for preparing an electroless copper plating solution, as recited in claim 20, wherein the second mixture has an acidic pH.

25. The method for preparing an electroless copper plating solution, as recited in claim 20, wherein the complexing agent is a polyamine-based complexing agent selected from a group consisting of a diamine compound, a triamine compound, or an aromatic polyamine compound.

* * * * *